United States Patent [19]

Könicke et al.

[11] 4,007,687

[45] Feb. 15, 1977

[54] PRIMING ARRANGEMENT IN A CASELESS POWDER CHARGE FOR SMALL-BORE WEAPONS

[75] Inventors: Helmut Könicke, Rothenbach, Pegnitz; Anton Politzer, Lauf, Pegnitz, both of Germany

[73] Assignee: DIEHL, Nurnberg, Germany

[22] Filed: Mar. 5, 1975

[21] Appl. No.: 556,337

[30] Foreign Application Priority Data

Mar. 6, 1974 Germany ..... 2410622

[52] U.S. Cl. ..... 102/45; 102/DIG. 1

[51] Int. Cl.[2] ..... F42B 9/16

[58] Field of Search ..... 102/DIG. 1, 45; 89/26

[56] References Cited

UNITED STATES PATENTS

| | | | |
|---|---|---|---|
| 3,114,290 | 12/1963 | Harvey et al. | 102/DIG. 1 |
| 3,396,658 | 8/1968 | Scanlon, Jr. et al. | 102/DIG. 1 |
| 3,688,697 | 9/1972 | Paul et al. | 102/DIG. 1 |
| 3,855,900 | 12/1974 | Barr et al. | 102/45 |

FOREIGN PATENTS OR APPLICATIONS

| | | | |
|---|---|---|---|
| 1,603,754 | 4/1966 | Germany | 102/45 |

*Primary Examiner*—Verlin R. Pendegrass

[57] ABSTRACT

A priming arrangement in a jacket-or a caseless powder body or charge for small-bore weapons. In a caseless powder body, provision is made for the firing pin, at ignition misfire, to penetrate into the powder charge, however, being totally encompassed and screened by the cylindrical sleeve and the primer cap. In accordance therewith, the powder is protected from the hot tip of the firing pin.

6 Claims, 3 Drawing Figures

PRIMING ARRANGEMENT IN A CASELESS POWDER CHARGE FOR SMALL-BORE WEAPONS

FIELD OF THE INVENTION

The present invention relates to a priming arrangement in a jacket-or caseless powder body or charge for small-bore weapons.

DISCUSSION OF THE PRIOR ART

A priming arrangement in a caseless powder charge has already been previously proposed. This priming affords the solution that erosion at the weapon-ended firing pin tip may be reduced.

In caseless powder bodies or charges incorporating mechanical priming, the heating of the firing pin becomes so extensive after a small number of shots, that an occurring misfired projectile is ignited through the heated firing pin tip. The thereby present personal danger and eventual influence upon the function of the weapon is considerably improved by the utilization of a construction according to the present invention.

SUMMARY OF THE INVENTION

According to the present invention, in a caseless powder body, provision is made for the firing pin, at ignition misfire, to penetrate into the powder charge, however, being totally encompassed and screened by the cylindrical sleeve and the primer cap. In accordance therewith, the powder is protected from the hot tip of the firing pin.

BRIEF DESCRIPTION OF THE DRAWINGS

Further advantageous constructions of the invention may now be ascertained from the following detailed description of the invention, taken in conjunction with the accompanying drawings; in which.

DETAILED DESCRIPTION

Figure 1:
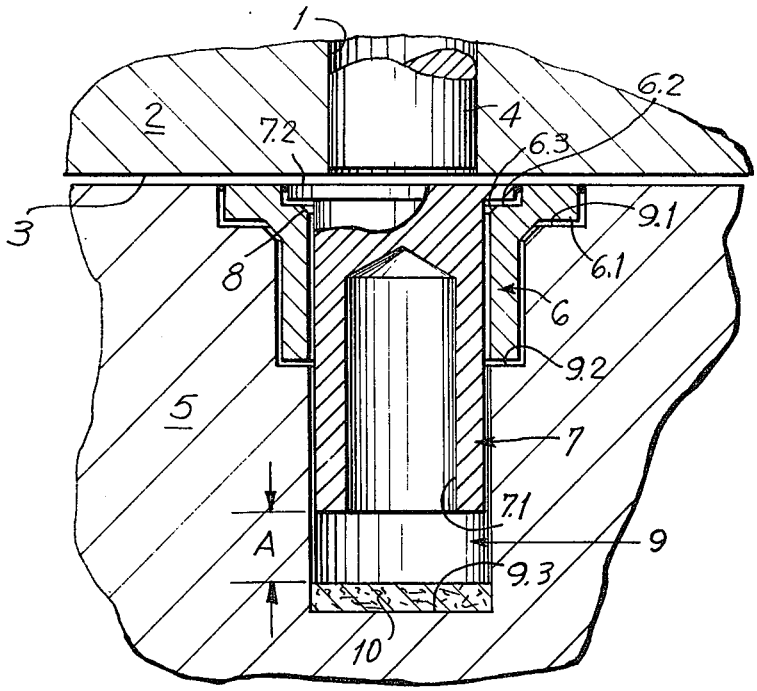
FIG. 1 illustrates in section a powder body or charge with the priming arrangement shown in the initial position thereof.

Referring now in detail to the drawings, in a bore 1 formed in a base portion 2 of a cartridge chamber 3 of a weapon (not shown) a firing pin 4 is shown supported in the initial position thereof. Located within the cartridge chamber 3 is a powder body or charge 5. This powder charge 5 incorporates a glued-in priming arrangement which is constituted of the following components:

A cylindrical sleeve 6 has a collar 6.1 and a pan-shaped recess 6.2, and a primer cap 7 having a recess 7.1 at an end-surface thereof. The primer cap 7 furthermore includes a relatively thin ring or flange 7.2 which lies in the recess 6.2 of the cylindrical sleeve 6 for anchoring purposes, and is glued therein. In the area of a notch or depression 8 formed by the flange 7.2 and by the primer cap 7, the cylindrical sleeve 6 is provided with a chamfer 6.3.

Within the powder charge 5 there is formed a bore 9 having two stepped portions 9.1 and 9.2, which receive the collar 6.1 and the cylindrical sleeve 6. At the base 9.3 of the bore 9 there is located a glued-in primer pad 10, with a safety space A being provided between the latter and the primer cap 7.

Suitable as the work material for the cylindrical sleeve 6 and the primer cap 7 is a brittle, difficultly combustible and low heat-conductive plastic material.

Figure 2:
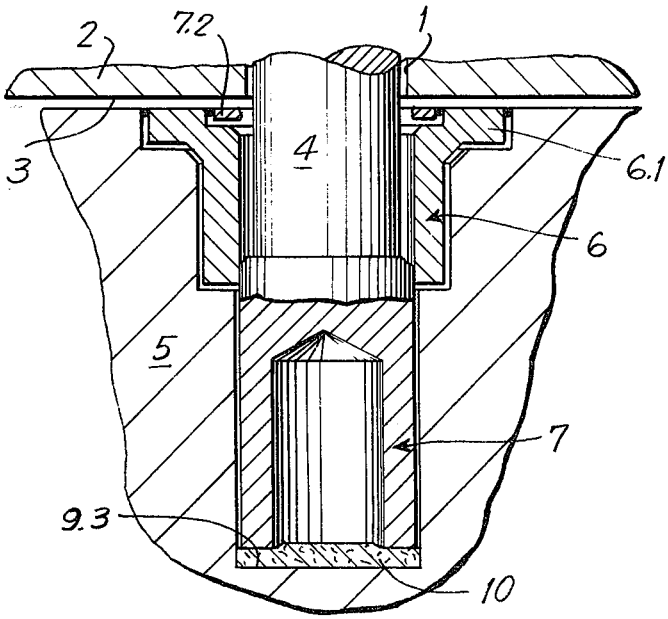
FIG. 2 illustrates the priming arrangement in the ignition position.

When the firing pin 4 is released for the ignition of the jacketless or caseless powder charge 5, it then propels or hits the primer cap 7 out of the cylindrical sleeve 6 by separating from the ring or flange 7.2 (FIG. 2). The firing pin 4 then drives the primer cap against the primer pad 10, the latter of which is thereby exploded, and the powder charge is ignited. During the total firing pin travel, the firing pin tip is on all sides thereof covered with respect to the powder by means of the cylindrical sleeve 6 and through the primer cap 7. Thereby, in the event of ignition misfire, the heat which is present in the firing pin tip cannot ignite the powder charge. The cylindrical sleeve 6 and the primer cap 7 form a heat-insulating arrangement with regard to the powder.

During the combustion sequence of the powder charge or, respectively, drive of a projectile, by means of the latter the separated rigid components of the ignition or priming arrangement are driven out of the weapon or gun barrel (not shown).

Figure 3:
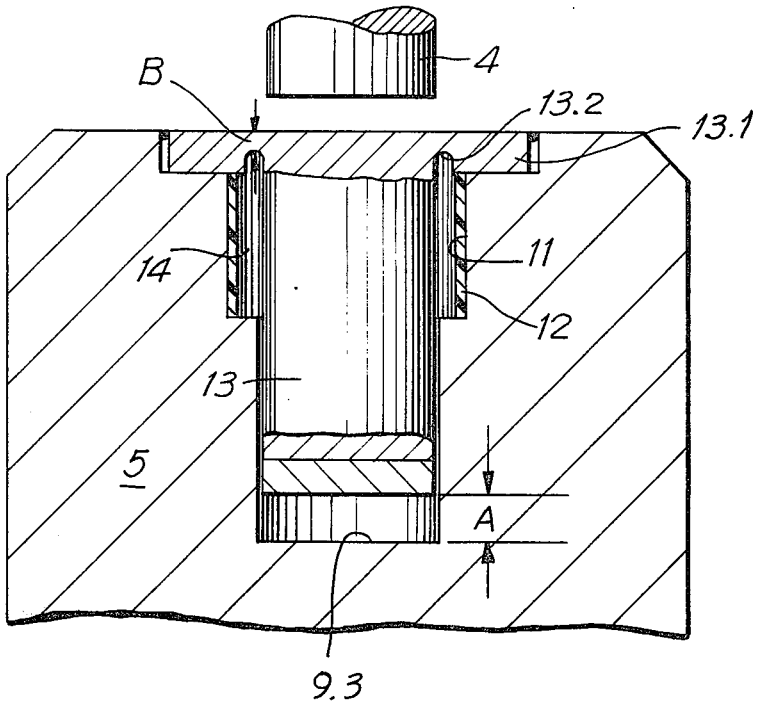
FIG. 3 shows a modified embodiment of the priming arrangement illustrated in FIG. 1.

With respect to the cylindrical sleeve 6 formed by the difficulty combustible plastic material, in contrast therewith, as shown in FIG. 3, in a widening 11 of a bore may have a lacquer layer 12, which assumes the temperature insulation of the firing pin tip with respect to the powder charge 5 in conjunction with the hollow chamber 14 which is located between the primer cap 13 and the lacquer layer 12. For this purpose the primer cap 13 is provided with a ring 13.1 at an end surface thereof which incorporates a breakage-point or fracture cross-section B formed by a notch or annular recess 13.2. The ring or flange 13.1 is glued to the powder charge 5. The primer pad 10 is glued to the primer pin 13 for the ready mounting thereof.

Upon impact of the firing pin 4 against the primer cap 13, the latter is sheared from the flange 13.1 at the fracture cross-section B, and is driven into the powder charge 5.

Thereby, the firing pin 4 remains within the zone of the lacquer layer 12 or, respectively, the hollow chamber 14. In that manner, during ignition misfire there is similarly formed an effective temperature insulation of the firing pin 4 from the powder charge 5. With respect to the foregoing, the ignition or combustion sequence follows in an analogous manner to that described with reference to FIGS. 1 and 2.

While there has been shown what is considered to be the preferred embodiment of the invention, it will be obvious that modifications may be made which come within the scope of the disclosure of the specification.

What is claimed is:

1. In a priming arrangement for small-bore weapons, including a powder charge having a bore for receiving a primer cap and a primer pad; and a firing pin; said primer pad being adapted to be exploded by said primer cap responsive to the latter being impacted by said firing pin by movement of said firing pin, the improvement comprising: a cylindrical sleeve in said bore, said primer cap being slidably located in said cylindrical sleeve, said firing pin being positioned to enter said cylindrical sleeve during firing movement thereof towards said primer cap, said cylindrical sleeve being constituted by a low heat-conductive, difficultly combustible material to provide insulation of the firing pin from said powder charge thereby preventing ignition of the powder charge during misfire.

2. A priming arrangement as claimed in claim 1, said primer cap having a shearable collar provided at one end thereof.

3. A priming arrangement as claimed in claim 1, said cylindrical sleeve being of a length in excess of the penetration depth of said firing pin into the powder charge.

4. A priming arrangement as claimed in claim 1, said cylindrical sleeve including a collar portion connectably closed with the end surface of said powder charge.

5. A priming arrangement as claimed in claim 4, said bore having two stepped portions, the end surfaces of said collar portion and said cylindrical sleeve respectively lying thereagainst.

6. A priming arrangement as claimed in claim 1, said bore being longer than said primer cap.

* * * * *